US005891072A

United States Patent [19]

Cady, Jr.

[11] Patent Number: 5,891,072

[45] Date of Patent: Apr. 6, 1999

[54] SNOWBOARDING BOOT SUPPORT PIECE AND PERFORMANCE ENHANCEMENT DEVICE

[76] Inventor: John R. Cady, Jr., 1145 Dowsville Rd., South Duxbury, Vt. 05660

[21] Appl. No.: 792,252

[22] Filed: Jan. 31, 1997

[51] Int. Cl.[6] ..... A61F 5/00; A43B 5/04

[52] U.S. Cl. ..... 602/27; 602/5; 36/88

[58] Field of Search ..... 602/5, 16, 23, 602/27, 60, 61, 62, 65, 18; 128/882, DIG. 23; 2/22; 482/79, 148; 36/88, 89, 115, 116, 117.1, 92

[56] References Cited

U.S. PATENT DOCUMENTS

| | | | |
|---|---|---|---|
| 2,763,071 | 9/1956 | Napier | 36/89 |
| 4,280,488 | 7/1981 | Polsky et al. | 602/65 X |
| 4,345,590 | 8/1982 | Nakajima | 602/65 |
| 5,366,438 | 11/1994 | Martin, Sr. | 602/5 |
| 5,520,619 | 5/1996 | Martin | 602/5 |
| 5,545,127 | 8/1996 | DeToro | 602/27 |
| 5,632,105 | 5/1997 | Bonaventure | 3/117.1 |
| 5,636,455 | 6/1997 | Meiselman | 36/115 |
| 5,716,336 | 2/1998 | Hines et al. | 602/27 |
| 5,722,187 | 3/1998 | Pamio et al. | 36/88 |

*Primary Examiner*—Lynne A. Reichard
*Assistant Examiner*—Denise Pothier
*Attorney, Agent, or Firm*—Thomas N. Neiman

[57] ABSTRACT

The snowboarding boot support piece and performance enhancement device is designed to provide the user with a device that supports the ankle joint, improves heel hold down and provides a more precise connection to the snowboard binding. The device is comprised of a single piece of resilient material that is shaped in a design having a base section and two side areas. The two side pieces are crossed which creates a single pivot point above the heel opening that allows the unit to articulate the movements of the user's ankle motions. The pivot point may be fixed by connection devices in such a way to fix the forward lean or limit the range of motion. The user places the snowboarding boot support piece and performance enhancement device is his or her snowboarding boot with the base portion at the heel of the boot and the sides positioned on either side of the ankle with the pivot point above and behind the heel.

9 Claims, 2 Drawing Sheets

FIG. 1
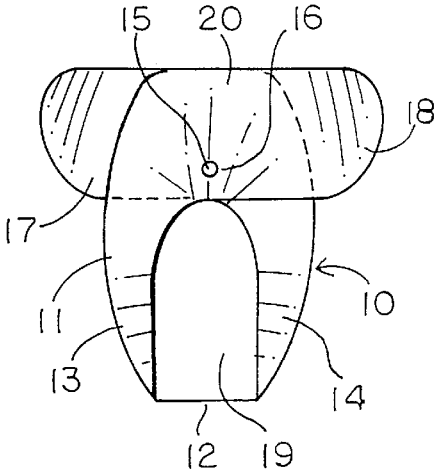
FIG. 2
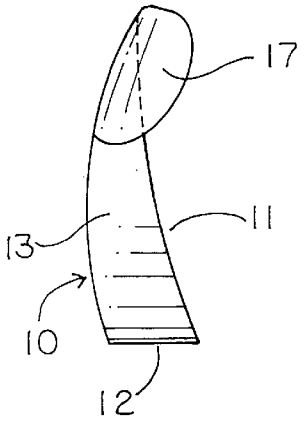
FIG. 3
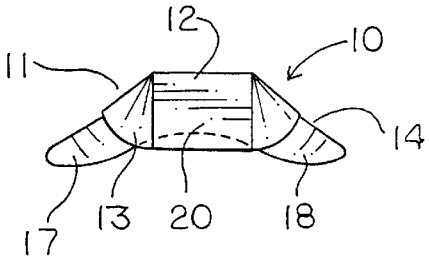
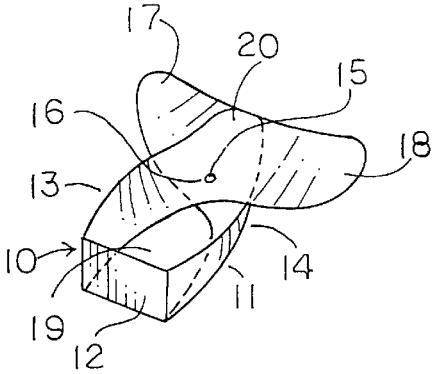
FIG. 4

SNOWBOARDING BOOT SUPPORT PIECE AND PERFORMANCE ENHANCEMENT DEVICE

BACKGROUND OF THE INVENTION

This invention pertains to snowboarding devices and, in particular, to a snowboarding boot support piece and performance enhancement device for use with snowboarding and other boots in order to provide articulated support for the ankle joint, improve the ability of the individual to hold his or her heel in position in the boot and provide a more precise connection to the binding of the snowboard.

A snowboard is a single ski wide enough to allow the rider to place his or her feet nearly perpendicular to the direction of travel. The board is manipulated more like a surfboard than a ski. It is therefor desirable to have a soft, flexible footware. Turning is done by balancing on both the heel end and the toe end. It is desirable to have calf support. Calf support is lacking in most current boots but when added enhances heel end performance. There are a number of reasons for using a device to improve control and improve the comfort for the individual that will enable individuals using the device to increase their personal performance.

There have been a number of attempts to improve support in ski boots and the like. Examples of these devices include the U.S. Pat. No. 5,226,875 issued to James Johnson on 13 Jul., 1993 for a Athletic Footware With Integral Ankle Support which does not account for ankle movement and the U.S. Pat. No. 5,449,005 issued to Tony R. Echols on 12 Sep., 1995 for a Removable, Shoe Interior Ankle Brace. These devices do provide ankle support for their users, but they do not provide the user the heel and calf control and the precise connection to the binding that is necessary when using skis or snowboards.

What is needed is a snowboarding boot support piece and performance enhancement device that provides articulating support for the ankle and calf of the individual using the device. What is also needed is a device that improves heel hold down for the user. Also, what is needed is a device that provides a more precise connection to the binding of the snowboard.

It is the object of this invention to teach a snowboarding boot support piece and performance enhancement device which avoids the disadvantages and limitations, recited above in previous support devices. Another object of this invention is to provide an apparatus that is cost effective, can be provided integrally in the boot or can be easy to install and use and, at the same time, be safe and effective.

SUMMARY OF THE INVENTION

Particularly, it is the object of this invention to teach a snowboarding boot support piece and performance enhancement device, for use in providing articulating support for the user's ankle, increasing heel hold down and providing a more precise connection to the snowboard binding, said structure comprising a resilient structure having a base section, the base section having a bottom area for receiving the heel of the user in order to provide support for the user; said resilient structure further having a plurality side areas, the side areas comprising flexible wings for adapting to the shape of the individual's ankle; said side areas having apertures positioned therein in each of said plurality of said side areas for creating a pivot point when said apertures are placed one over the other as said side areas are crossed over behind the heel of the user; and said apertures in said plurality of said side areas having connection means inserted therein for allowing restriction or limiting of the range of motion of said snowboarding boot support piece and performance enhancement device. It is also the object of this invention to teach a snowboarding boot support piece and performance enhancement device, for use in providing articulating support for the user's ankle and calf, increasing the heel hold down and allowing a more precise connection to the snowboard binding, comprising a resilient structure having a base section, the base section having a bottom area for receiving the heel of the user in order to provide support for the user; said resilient structure further having a plurality of side areas comprising flexible wings for adapting said resilient structure to the shape of the ankle of the individual; each of said plurality of said side areas having a pivot point therein when said side areas are crossed over behind the heel of the user; and detachable connection means for allowing restriction or limiting of the range of motion allowed by the snowboarding boot support piece and performance enhancement device.

BRIEF DESCRIPTION OF THE DRAWINGS

Further objects and features of this invention will become more apparent by reference to the following description taken in conjunction with the following figures, in which:

FIG. 1 is a front elevational view of the novel snowboarding boot support piece and performance enhancement device;

FIG. 2 is a side elevational view thereof;

FIG. 3 is a bottom plan view thereof;

FIG. 4 is a perspective view thereof;

DETAILED DESCRIPTION OF THE PREFERRED EMBODIMENT

Figure 5:
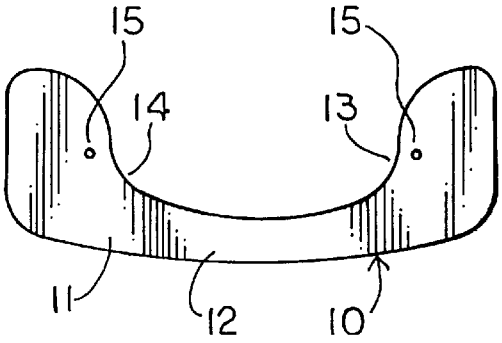
FIG. 5 is a top plan view of the device in its prefolded state.
Figure 6:
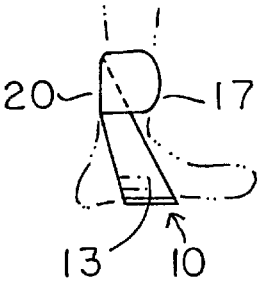
FIG. 6, 6A and 6B are smaller side elevation view of the device's position on the user's ankle during the movement of the ankle.
Figure 6A:
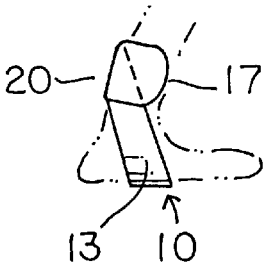
Figure 6B:
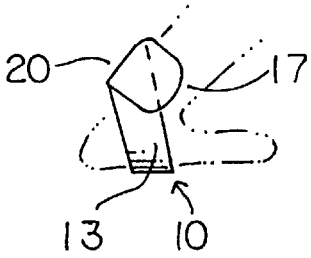

As shown in the figures, the novel snowboarding boot support piece and performance enhancement device 10 comprises a single resilient structure 11 that when flattened in a single plane is a U shaped unit. It has a base section 12 that is positioned under the heel of the user and has two side areas 13 and 14 which are folded to cross over each other when in use. The side areas 13 and 14 each have a pivot point 15 which is aligned when the device 10 has been crossed over. The pivot point 15 is located above the heel of the user and centered above the heel which fits in the opening 19 created by the folded shape of the device 10.

In the embodiment shown, an aperture is positioned in the side areas 13 and 14 and a rivet 16 is installed to hold the device together at the pivot point 15 in position and limit the range of motion of the device 10. The extensions 17 and 18 of the side areas 13 and 14 extend around the ankle of the user. It is also possible to use a material hook and loop fastening material adjacent to the pivot point 15 and create a device 10 which can be either connected and range limited or not connected and allow free range of motion of the foot, ankle and calf of the user.

The one piece lightweight material uniquely shaped and formed to be inserted into existing snowboard boots which may or may not be part of a step in snowboard binding system. A single pivot point, above the heel opening, allows the crossed portion 20 or cuff to articulate with the user's ankle movements and creates a means for articulating the user's ankle movements. The fixing of the forward lean and or the limiting of the range of movement can be accomplished by positioning apertures or slots and riveting the cuff together to limit travel or by positioning hook and loop fastening material between the crossed portion 20 to fix the forward lean. The device can also be constructed within the boot itself.

While I have described my invention in connection with specific embodiments thereof, it is clearly to be understood that this is done only by way of example and not as a limitation to the scope of my invention as set forth in the objects thereof and in the appended claims.

I claim:

1. A snowboarding boot support piece and performance enhancement device, for use in providing articulating support for the user's ankle, increasing heel hold down and providing a more precise connection to the snowboard binding, said structure comprising:

a resilient structure having a base section, the base section having a bottom area for receiving the heel of the user in order to provide support for the user;

said resilient structure further having a plurality of side areas, the side areas comprising flexible wings for adapting to the shape of the individual's ankle;

said side areas having apertures positioned therein in each of said plurality of side areas for creating a pivot point when said apertures are placed one over the other as said side areas are crossed over behind the heel of the user; and said apertures in said side areas having connection means inserted therein for allowing restriction of travel of said snowboarding boot support piece and performance enhancement device.

2. A snowboarding boot support piece and performance enhancement device, according to claim 1, wherein:

said resilient structure comprising a construction of plastic material.

3. A snowboarding boot support piece and performance enhancement device, according to claim 1, wherein:

said base section and said plurality of side areas comprising a U shaped design when said base section and said plurality of side areas are positioned in a flattened horizontal plane.

4. A snowboarding boot support piece and performance enhancement device, according to claim 1, wherein:

said pivot point on said plurality of said side areas comprises a means for articulating the user's ankle movements.

5. A snowboarding boot support piece and performance enhancement device, according to claim 1, wherein:

said connection means comprises a riveted structure.

6. A snowboarding boot support piece and performance enhancement device, for use in providing articulating support for the user's ankle, increasing heel hold down and allowing a more precise connection to the snowboard binding, comprising:

a resilient structure having a base section, the base section having a bottom area for receiving the heel of the user in order to provide support for the user;

said resilient structure further having a plurality of side areas comprising flexible wings for adapting said resilient structure to the shape of the ankle of the individual's ankle;

each of said plurality of side areas having a pivot point located therein when said side areas are crossed over behind the heel of the user; and detachable connection means attached to said plurality of side areas for allowing restriction or limiting of the range of motion allowed by said snowboarding boot support piece and performance enhancement device.

7. A snowboarding boot support piece and performance enhancement device, according to claim 6, wherein:

said resilient structure comprising a construction of plastic material.

8. A snowboarding boot support piece and performance enhancement device, according to claim 6, wherein:

said base section and said plurality of side areas comprising a U shaped design when said base section and said plurality of side areas are positioned in a flattened horizontal plane.

9. A snowboarding boot support piece and performance enhancement device, according to claim 6, wherein:

said pivot point on said plurality of said side areas comprises a means for articulating the user's ankle movements.

* * * * *